US009404365B2

(12) United States Patent
Taylor et al.

(10) Patent No.: US 9,404,365 B2
(45) Date of Patent: Aug. 2, 2016

(54) STEAM DIFFUSING APPARATUS AND RELATED METHODS

(71) Applicant: TAYLOR'S INDUSTRIAL COATINGS, INC., Lake Wales, FL (US)

(72) Inventors: Gregory Taylor, Lake Wales, FL (US); Scott Taylor, Lake Wales, FL (US)

(73) Assignee: TAYLOR'S INDUSTRIAL COATINGS, INC., Lake Wales, FL (US)

( * ) Notice: Subject to any disclaimer, the term of this patent is extended or adjusted under 35 U.S.C. 154(b) by 208 days.

(21) Appl. No.: 14/146,796

(22) Filed: Jan. 3, 2014

(65) Prior Publication Data

US 2014/0224369 A1 Aug. 14, 2014

Related U.S. Application Data

(60) Provisional application No. 61/764,234, filed on Feb. 13, 2013.

(51) Int. Cl.
*B05B 1/14* (2006.01)
*F01B 31/16* (2006.01)

(52) U.S. Cl.
CPC ..... *F01B 31/16* (2013.01); *Y10T 29/494* (2015.01)

(58) Field of Classification Search
CPC ..... Y10T 29/494; F01B 31/16
USPC ..... 239/518, 504, 462
See application file for complete search history.

(56) References Cited

U.S. PATENT DOCUMENTS

| | | | | |
|---|---|---|---|---|
| 1,896,514 | A | 2/1933 | Hoyt | |
| 3,635,309 | A | 1/1972 | Nemcansky et al. | |
| 3,776,365 | A * | 12/1973 | Richards | F01N 1/10 181/256 |
| 3,858,677 | A | 1/1975 | Bussey | |
| 4,880,447 | A | 11/1989 | Bloch | |
| 5,109,950 | A * | 5/1992 | Lescher | F01N 1/06 181/256 |
| 6,968,923 | B2 | 11/2005 | Schmaeman | |
| 7,753,167 | B2 * | 7/2010 | Fukano | F04B 39/0027 181/158 |
| 2004/0040274 | A1 * | 3/2004 | Amann | B01D 46/2411 55/498 |

* cited by examiner

*Primary Examiner* — Jason Boeckmann
(74) *Attorney, Agent, or Firm* — Allen, Dyer, Doppelt, Milbrath & Gilchrist, P.A.

(57) ABSTRACT

A steam diffusing apparatus may include a steam inlet tube having steam-dispersion openings adjacent a lower end thereof and a mass of filaments surrounding the plurality of steam dispersion openings. The steam diffusing apparatus may also include a retaining tube surrounding the mass of filaments, a housing surrounding the retaining tube and having outlet openings therein, and an upper end cap coupled to an upper end of the housing and having an opening therein receiving the steam inlet tube. A lower end cap may be coupled to a lower end of the housing.

33 Claims, 5 Drawing Sheets

STEAM DIFFUSING APPARATUS AND RELATED METHODS

RELATED APPLICATION

The present application is based upon previously filed co-pending provisional application Ser. No. 61/764,234, filed Feb. 13, 2013, the entire subject matter of which is incorporated by reference in its entirety.

FIELD OF THE INVENTION

The present invention is related to the field of steam, and, more particularly to the field of steam diffusers, and related methods.

BACKGROUND

Steam is particularly useful in modern technology. For example, steam may be particularly useful in food, textile, chemical, medical, power, heating, and transport industries. One use of steam is for transporting controllable amounts of energy from a central, automated boiler house, where it can be efficiently and economically generated, to the point of use. Therefore as steam moves around a plant, for example, it may equally be considered to be the transport and provision of energy. This may be particularly useful for conveying heat energy. In particular, steam may be relatively efficient and economic to generate, may easily and cost effectively be distributed to a point of use, and is relatively easy to control.

Steam, for example, is linked between a steam generator and a steam user by a steam distribution system. The steam distribution system may include several elements coupled together, for example, pipes, drain points, branch lines, filters, strainers, separators, stream traps, and air vents. Steam traps may be used to drain, to atmosphere, open ended pipes in the steam distribution system, and thus the discharge of relatively hot condensate may be possible. Flash steam may also be present relative to the condensate pressure before a steam trap.

This may be particularly hazardous to a person passing by the discharge. However, by reducing the severity of the discharge, the hazard may be reduced. One way of reducing the severity of the discharge is through the use of a steam diffuser. A steam diffuser may be fitted to an end of an open pipe. The steam diffuser may reduce the intensity of the discharge and may also reduce noise associated with the discharge.

One example of a steam diffuser is a DF1 available from Spirax-Sarco Limited of Gloucestershire, United Kingdom. The DF1 diffuser includes a knitted and compacted diffusing wire mesh element to dissipate energy in the discharge. The DF1 diffuser is fitted to an outlet of a steam pipe and includes a mesh outlet opposing the inlet and a continuous cylindrical housing between the inlet and outlet.

SUMMARY

A steam diffusing apparatus may include a steam inlet tube having steam-dispersion openings adjacent a lower end thereof and a mass of filaments surrounding the plurality of steam dispersion openings. The steam diffusing apparatus may also include a retaining tube surrounding the mass of filaments, a housing surrounding the retaining tube and having outlet openings therein, and an upper end cap coupled to an upper end of the housing and having an opening therein receiving the steam inlet tube. A lower end cap may be coupled to a lower end of the housing. Accordingly, the steam diffusing apparatus may provide reduced steam discharge, for example, by allowing the discharged steam to condensate and drip from the steam diffuser as water, which may reduce the hazard associated with a steam discharge.

The mass of filaments may extend upwardly to a medial portion of the steam inlet tube. The retaining tube may be coextensive with the mass of filaments, for example.

The steam inlet tube may have a closed lower end. The mass of filaments may include wire wool, for example.

The steam diffusing apparatus may also include a mesh screen covering the plurality of outlet openings. The housing may be spaced apart from the retaining tube, for example. The housing may have a cylindrical shape.

A method aspect is directed to a method of making a steam diffusing apparatus. The method may include positioning a mass of filaments to surround a plurality of steam dispersion openings in a lower end of a steam inlet tube and positioning a retaining tube to surround the mass of filaments. The method may also include positioning a housing to surround the retaining tube. The housing has a plurality of outlet openings therein. The method may further include coupling an upper end cap to an upper end of the housing. The upper end cap has opening therein receiving the steam inlet tube. The method may further include coupling a lower end cap to a lower end of the housing.

DETAILED DESCRIPTION

The present description is made with reference to the accompanying drawings, in which example embodiments are shown. However, many different embodiments may be used, and thus the description should not be construed as limited to the embodiments set forth herein. Rather, these embodiments are provided so that this disclosure will be thorough and complete. Like numbers refer to like elements throughout.

Figure 1:
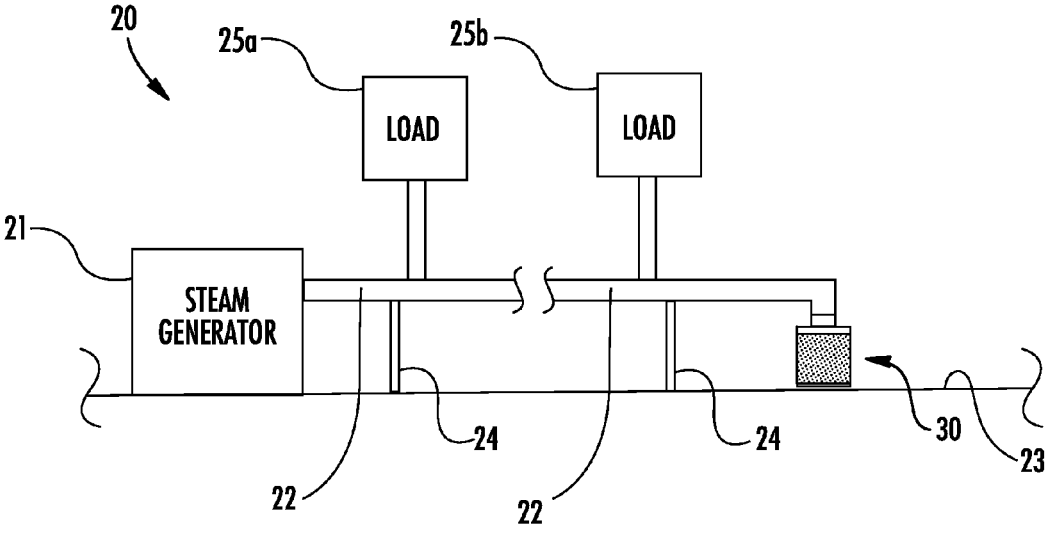
FIG. 1 is a schematic diagram of a portion of a steam system including a steam diffusing apparatus according to the present invention.

Referring initially to FIG. 1, a steam system 20 includes a steam generator 21 and pipes 22 conveying steam generated from the steam generator. The pipes 22 may extend along the ground 23 and be supported by supports 24. Steam loads 25*a*, 25*b* may be coupled to the steam generator 21. A steam diffusing apparatus 30 is coupled to an open end of one of the pipes 22. As will be appreciated by those skilled in the art, additional steam system elements may be used with the steam system 20. The steam diffusing apparatus 30 advantageously reduces steam discharge from the pipe 22 coupled thereto. The steam diffusing apparatus 30 also reduces sound generated from the steam discharge. In other words, the steam diffusing apparatus 30 is configured to perform like a muffler.

Figure 2:
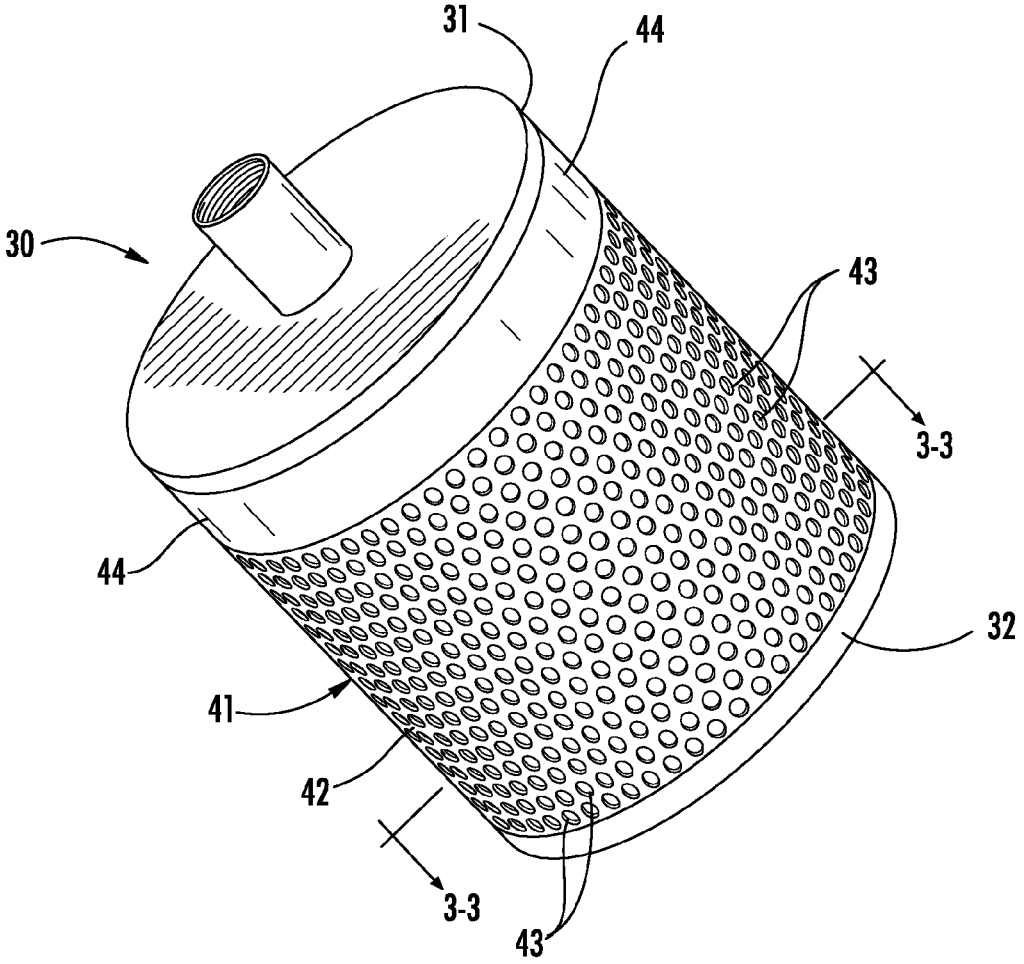
FIG. 2 is a perspective view of the steam diffusing apparatus of FIG. 1.
Figure 3:
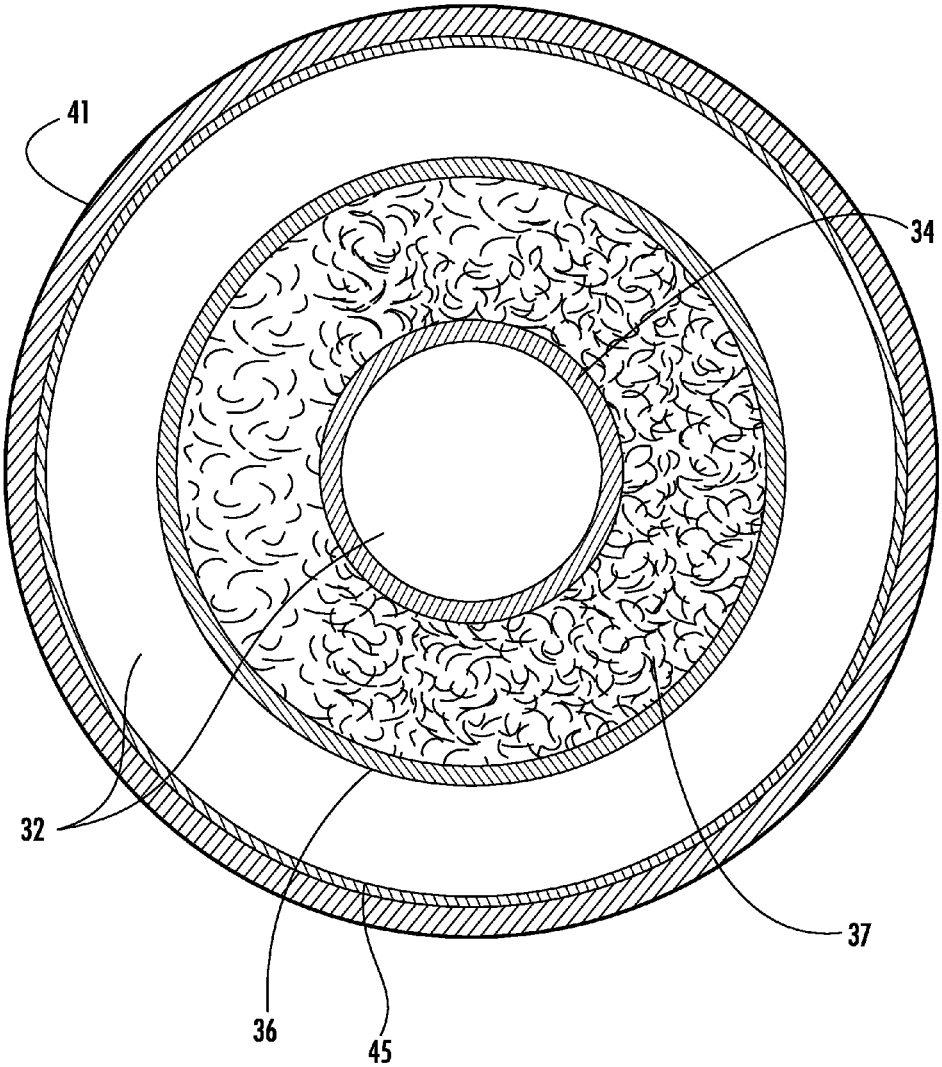
FIG. 3 is a cross-sectional view of the steam diffuser of FIG. 2 taken along line 3-3.
Figure 4:
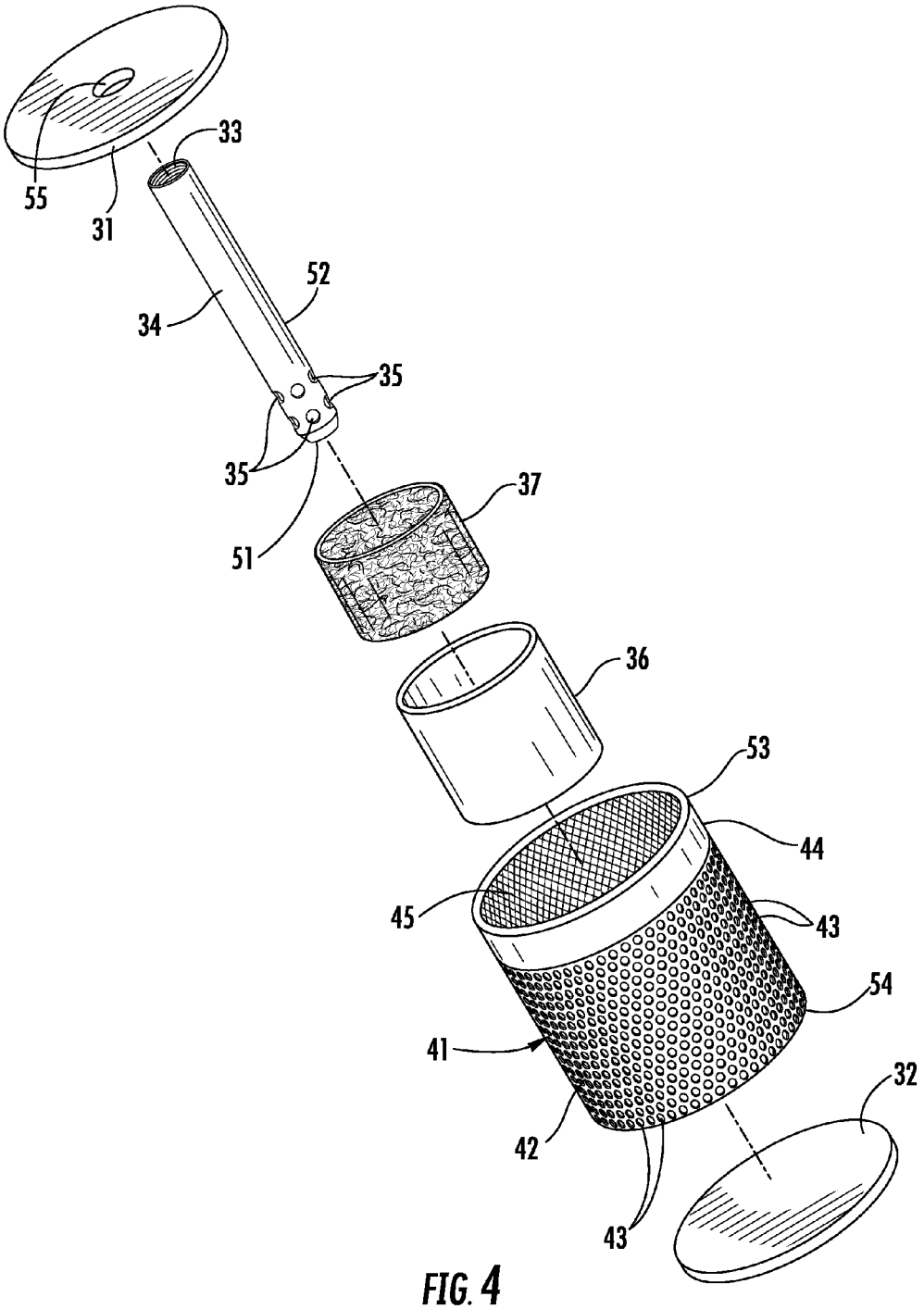
FIG. 4 is an exploded view of the steam diffusing apparatus of FIG. 1.

Referring now additionally to FIGS. 2-4, the steam diffusing apparatus 30 includes a steam inlet tube 34 that has steam-dispersion openings 35 therein adjacent a lower end 51 thereof. The lower end 51 of the steam inlet tube 34 is illustratively closed, which may allow increased amounts of steam to pass through the steam dispersion openings. The steam inlet tube 34 may have a length of six inches and a diameter of three-quarters of an inch, for example. Of course, the steam inlet tube 34 may have another length and/or diameter, for example, based upon the application and steam system, as will be appreciated by those skilled in the art. The steam-dispersion openings 35 may extend upwardly 2.5 inches from the lower end 51. The steam-dispersion openings 35 may have a size in a range of about 3/16 of an inch to about 3/8 of an inch. About eight steam-dispersion openings 35 may be formed within the steam inlet tube 34. The steam dispersion openings 35 may be longitudinally aligned along the steam inlet tube 34. Of course, in some embodiments, the steam inlet tube 34 may include a different number of steam dispersion openings, each or all having a different size, and some or all of which may not be aligned.

The steam inlet tube 34 also includes a threaded upper end 33 for coupling with the steam pipe 22, as illustrated. Of course the threaded upper end 33 may include either of male or female threads, and in some embodiments, other types of couplers other than threads may be used.

A mass of filaments 37 surrounds the steam inlet tube 34 adjacent the steam-dispersion openings 35. More particularly, the mass of filaments 37 may be steel filaments bundled together to form wire wool, for example, steel wool or stainless steel wool. The mass of filaments 37 may be another type of material.

Approximately five feet of the wire wool 37 is positioned or wrapped around the steam inlet tube 34. The wire wool 37 may extend upwardly from the lower end 51 about five inches to a medial portion 52 of the steam inlet tube 34, which may be just beyond or above the steam dispersion openings 35.

The steam diffusing apparatus 30 also includes a retaining tube 36 spaced apart from and surrounding the steam inlet tube 34. More particularly, the retaining tube 36 is adjacent the steam-dispersion openings 35. The retaining tube 36 may be 0.083 gauge stainless steel. Of course the retaining tube 36 may be another type of material and have another thickness or gauge.

The retaining tube 36 may extend to within ±10% of half a medial portion of the steam inlet tube 34 and/or to be and coextensive with the mass of filaments 37. In one embodiment, the retaining tube 36 may be about 2.5 inches tall and may be aligned with the steam dispersion openings 35, which may also extend 2.5 inches from the lower end 51 of the steam inlet tube 34. The retaining tube may have another height, for example, 2.5 inches ±0.25 inches. The retaining tube 36 illustratively does not have any openings therein A housing 41 having a cylindrical shape surrounds the retaining tube 36 and the tubular steam conduit 34. More particularly, the housing 41 is slidably positioned over the retaining tube 36 in spaced relation therefrom. The housing 41 has a lower segment 42 illustratively having 1/4-inch diameter outlet openings 43 in a honeycomb pattern. Of course, in some embodiments, the outlet openings 43 may have a different size or shape and may not be in a honeycomb pattern. The lower segment 42 may extend about 4.5 inches, for example, from a lower end 54 of the housing 41. The outer tubular housing 41 has an upper segment 44 extending about a half-inch between from an upper end 53 thereof.

A mesh screen 45, for example, in the form of #20 mesh wire, may be carried by an interior surface of the housing 41. More particularly, the mesh screen 45 may extend on an inner surface of the lower segment 42 and may cover the outlet openings 43.

The steam diffusing apparatus 30 includes an upper end cap 31 coupled to the upper end 53 of the housing 41. The upper end cap 31 has an opening 55 therein to receive the steam inlet tube 34 therein. The upper end cap 31 may be welded, for example, laser welded to the upper segment 44 of the housing 41.

A lower end cap 32 is coupled to a lower end 54 of the housing 41. The retaining tube 36 may be coupled to the lower end cap 32 by a welded or laser welded connection, for example.

Each of the upper and lower end caps 31, 32 is about an eighth of an inch thick. Of course, the upper and lower end caps 31, 32 may have other sizes or thicknesses.

Accordingly, the steam diffusing apparatus 30 has an overall cylindrical or circular shape and extends about five inches in height and has a four-inch diameter. Of course, the steam diffusing apparatus 30 may have other dimensions, as will be appreciated by those skilled in the art.

Figure 5:
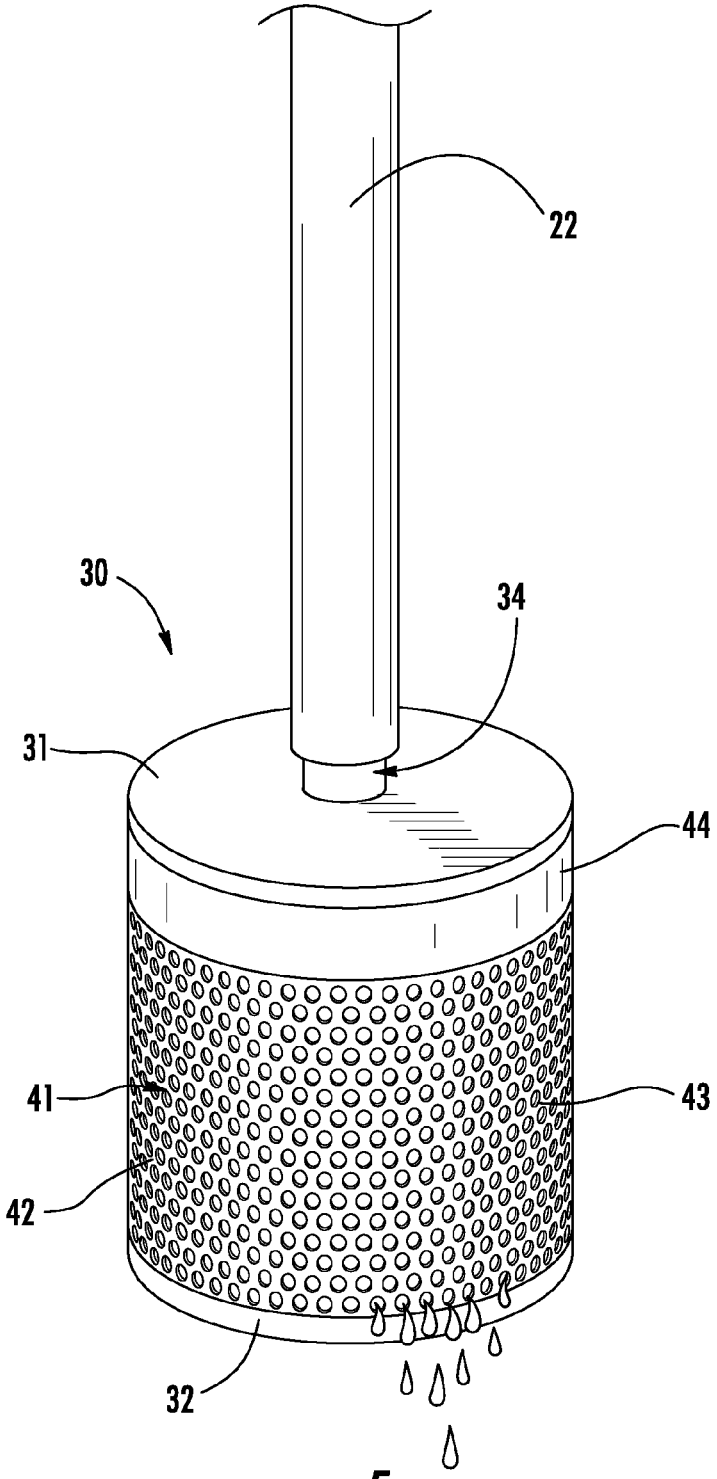
FIG. 5 is a front elevation view of a steam diffusing apparatus in accordance with the present invention.

Referring now additionally to FIG. 5, in operation, steam from the steam pipe 22 is typically discharged in relatively loud audible bursts. After coupling the steam diffusing apparatus 30 to the steam pipe 22 and upon the first burst of steam, the steam passes through the steam inlet tube 34 and the steam dispersion openings 35. The steam condenses as it passes through the wire wool 37, and water fills within the retaining tube 36. The water collected or filled within the retaining tube 36 cools. Upon a further burst of steam, additional water fills within the retaining tube 36 so that the level of cooled water within the retaining tube rises above the top of the retaining tube. The cooled water overflows from the retaining tube 36 and flows out of the steam diffusing apparatus 30 through the mesh screen 45 and the openings 43 in the housing 41. The cooled water may be collected or simply fall to the ground.

As will be appreciated by those skilled in the art, the steam diffusing apparatus 30 acts like a muffler for the steam and may advantageous decrease the noise from each steam burst. Additionally, the steam diffusing apparatus 30 may increase safety, for example, by transforming a steam burst to a temperature cooled water drip.

A method of making a steam diffusing apparatus 30 includes positioning a mass of filaments 37 to surround steam dispersion openings 35 in a lower end 51 of the steam inlet tube 34. The method includes positioning a retaining tube 36 to surround the mass of filaments 37. The method also includes positioning a housing 41 to surround the retaining tube 36. The housing 41 has outlet openings 43 therein.

The method further includes coupling an upper end cap 31 to an upper end of the housing 41. The upper end cap 31 has an opening 55 therein receiving the steam inlet tube 34. The method also includes coupling a lower end cap 32 to a lower end 54 of the housing 41.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims. Additionally, while specific exemplary dimensions, sizes, and shapes have been described with respect to an embodiment, it should be understood that in other embodiments, the dimensions, sizes, and shapes may be different.

That which is claimed is:

1. A steam diffusing apparatus comprising:

a steam inlet tube having a plurality of steam-dispersion openings adjacent a lower end thereof;

a mass of filaments surrounding the plurality of steam dispersion openings;

a solid retaining tube surrounding said mass of filaments;

a housing surrounding said solid retaining tube and having a plurality of outlet openings therein, said housing having a length longer than a length of said solid retaining tube;

a mesh screen covering the plurality of outlet openings;

an upper end cap coupled to an upper end of said housing and having an opening therein receiving said steam inlet tube; and a lower end cap coupled to a lower end of said housing and being devoid of openings therein.

2. The steam diffusing apparatus of claim 1, wherein said mass of filaments extends upwardly to a medial portion of said steam inlet tube.

3. The steam diffusing apparatus of claim 2, wherein said solid retaining tube is coextensive with said mass of filaments.

4. The steam diffusing apparatus of claim 1, wherein said steam inlet tube has a closed lower end.

5. The steam diffusing apparatus of claim 1, wherein said mass of filaments comprises wire wool.

6. The steam diffusing apparatus of claim 1, wherein said housing is spaced apart from said retaining tube.

7. The steam diffusing apparatus of claim 1, wherein said housing has a cylindrical shape.

8. A steam diffusing apparatus comprising:

a steam inlet tube having a plurality of steam-dispersion openings adjacent a closed lower end thereof;

a mass of filaments surrounding the plurality of steam dispersion openings;

a solid retaining tube surrounding said mass of filaments;

a housing surrounding said solid retaining tube and having a plurality of outlet openings therein, said housing having a length longer than a length of said solid retaining tube;

a mesh screen covering the plurality of outlet openings;

an upper end cap coupled to an upper end of said housing and having an opening therein receiving said steam inlet tube; and a lower end cap coupled to a lower end of said housing and being devoid of openings therein.

9. The steam diffusing apparatus of claim 8, wherein said mass of filaments extends upwardly to a medial portion of said steam inlet tube.

10. The steam diffusing apparatus of claim 9, wherein said solid retaining tube is coextensive with said mass of filaments.

11. The steam diffusing apparatus of claim 8, wherein said mass of filaments comprises wire wool.

12. The steam diffusing apparatus of claim 8, wherein said housing is spaced apart from said solid retaining tube.

13. The steam diffusing apparatus of claim 8, wherein said housing has a cylindrical shape.

14. A method of making a steam diffusing apparatus comprising:

positioning a mass of filaments to surround a plurality of steam dispersion openings in a lower end of a steam inlet tube;

positioning a solid retaining tube to surround the mass of filaments;

positioning a housing to surround the solid retaining tube and having a plurality of outlet openings therein, the housing having a length longer than a length of the solid retaining tube;

positioning a mesh screen to cover the plurality of outlet openings;

coupling an upper end cap to an upper end of the housing and having an opening therein receiving the steam inlet tube; and coupling a lower end cap to a lower end of the housing, the lower end cap being devoid of openings therein.

15. The method of claim 14, wherein the mass of filaments is positioned to extend upwardly to a medial portion of the steam inlet tube.

16. The method of claim 15, wherein the solid retaining tube is positioned to be coextensive with the mass of filaments.

17. The method of claim 14, wherein the steam inlet tube has a closed lower end.

18. The method of claim 14, wherein the mass of filaments comprises wire wool.

19. The apparatus of claim 14, wherein the housing is positioned to be spaced apart from the solid retaining tube.

20. A steam diffusing apparatus comprising:

a steam inlet tube having a plurality of steam-dispersion openings adjacent a lower end thereof;

a mass of filaments surrounding the plurality of steam dispersion openings;

a solid retaining tube surrounding said mass of filaments;

a housing surrounding said solid retaining tube and comprising a tubular body having opposing open ends, said tubular body having a plurality of outlet openings therein and a length longer than a length of said solid retaining tube;

a mesh screen covering the plurality of outlet openings;

an upper end cap coupled to an upper end of said housing and having an opening therein receiving said steam inlet tube; and a lower end cap coupled to a lower end of said housing.

21. The steam diffusing apparatus of claim 20, wherein said mass of filaments extends upwardly to a medial portion of said steam inlet tube.

22. The steam diffusing apparatus of claim 21, wherein said solid retaining tube is coextensive with said mass of filaments.

23. The steam diffusing apparatus of claim 20, wherein said steam inlet tube has a closed lower end.

24. The steam diffusing apparatus of claim 20, wherein said mass of filaments comprises wire wool.

25. The steam diffusing apparatus of claim 20, wherein said housing is spaced apart from said solid retaining tube.

26. The steam diffusing apparatus of claim 20, wherein said housing has a cylindrical shape.

27. A steam diffusing apparatus comprising:

a steam inlet tube having a plurality of steam-dispersion openings adjacent a lower end thereof;

a mass of filaments surrounding the plurality of steam dispersion openings;

a solid retaining tube surrounding said mass of filaments;

a housing surrounding said solid retaining tube, extending along a length of said steam inlet tube for a length longer than a length of said solid retaining tube, and having a plurality of outlet openings therein;

a mesh screen covering the plurality of outlet openings;

an upper end cap coupled to an upper end of said housing and having an opening therein receiving said steam inlet tube; and a lower end cap coupled to a lower end of said housing adjacent said steam inlet tube.

28. The steam diffusing apparatus of claim 27, wherein said mass of filaments extends upwardly to a medial portion of said steam inlet tube.

29. The steam diffusing apparatus of claim 28, wherein said solid retaining tube is coextensive with said mass of filaments.

30. The steam diffusing apparatus of claim 27, wherein said steam inlet tube has a closed lower end.

31. The steam diffusing apparatus of claim 27, wherein said mass of filaments comprises wire wool.

32. The steam diffusing apparatus of claim 27, wherein said housing is spaced apart from said solid retaining tube.

33. The steam diffusing apparatus of claim 27, wherein said housing has a cylindrical shape.

* * * * *